US007390229B2

(12) United States Patent
Huang et al.

(10) Patent No.: US 7,390,229 B2
(45) Date of Patent: Jun. 24, 2008

(54) BATTERY CONNECTOR

(75) Inventors: Chung-Hsin Huang, Tu-Cheng (TW); Yun-Chien Lee, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 106 days.

(21) Appl. No.: 11/395,188

(22) Filed: Apr. 3, 2006

(65) Prior Publication Data

US 2007/0232102 A1 Oct. 4, 2007

(51) Int. Cl.
*H01R 4/48* (2006.01)

(52) U.S. Cl. ..... 439/862

(58) Field of Classification Search ..... 439/862, 439/500, 626, 81

See application file for complete search history.

(56) References Cited

U.S. PATENT DOCUMENTS 5,746,626 A * 5/1998 Kwiat et al. ..... 439/630
5,885,090 A * 3/1999 Comstock et al. ..... 439/65
6,113,440 A * 9/2000 Fijten et al. ..... 439/862
6,302,727 B1 * 10/2001 Fedorjaka ..... 439/500
6,663,444 B2 * 12/2003 Yeh ..... 439/862
6,695,628 B2 * 2/2004 Yeh ..... 439/83
6,994,576 B2 * 2/2006 Tanaka et al. ..... 439/188
7,258,571 B1 * 8/2007 Chen ..... 439/500
2004/0161979 A1 * 8/2004 Kyowski et al. ..... 439/660

* cited by examiner

*Primary Examiner*—Tulsidas C. Patel
*Assistant Examiner*—Vladimir Imas
(74) *Attorney, Agent, or Firm*—Rosenberg, Klein & Lee

(57) ABSTRACT

A battery connector includes a dielectric housing having a plurality of terminal passages. A plurality of terminals are received in the terminal passages. Each terminal includes a supporting portion, a press portion twisted up in the front portion of the supporting portion, a first bending portion extending from the rear portion of the supporting portion, an elastic portion formed on the end of the first bending portion, a plug portion extending from the end of the elastic portion, a second bending portion formed on the upper portion of the plug portion, a guidable portion extending from the second bending portion. The supporting portion and the press portion extending out of a bottom surface of the dielectric housing to contact a printed circuit board elastically so that the signal between the battery connector and a electronic device transmits stably and the assembly height of the battery connector is adjustable.

5 Claims, 5 Drawing Sheets

BATTERY CONNECTOR

BACKGROUND OF THE INVENTION

1. Field of the Invention

The present invention relates to a battery connector, and in particular to a battery connector which ensures that the signal between the battery connector and a electronic device is transmitted stably and the assembly height of the battery connector is adjustable.

2. The Related Art

Electronic appliances are widely used more and more with the development of the technology of the electrons. The electronic appliances usually utilize rechargeable batteries as power sources. Accordingly, a battery connector adapted to connect batteries to the electronic appliances is used widely. However, life-time of the battery connector is influenced by the frequently loading and unloading of the power sources. Therefore, the battery connector which has a long life-time is needed urgently.

Referring to FIG. 4 and FIG. 5, a conventional battery connector 100' includes a dielectric housing 10' and a plurality of terminals 20' fixed thereto. The dielectric housing 10' includes a rear wall 11', two side walls 12' and a plurality of terminal passages 13'. The terminal 20' includes a soldering portion 21', a plug portion 22' extending from the soldering portion 21', a bending portion 23' extending from the plug portion 22', and a contacting portion 24' extending from the bending portion 23'. The bending portion 23' includes a first curved surface 231' and a second curved surface 232'. The contacting portion 24' includes a third curved surface 241'.

The plug portion 22' plugs into the terminal passage 13'. The inner side of the plug portion 22' contacts the inner surface of the rear wall 11'. The soldering portion 21' welds with a printed circuit board. When the third curved surface 241' of the contacting portion 24' is pressed, the first curved surface 231' and the second curved surface 232' share the stress with the third curved surface 241' in order to make the terminal 20' have a longer life-time.

However, in the progress of assembling, the battery connector 100' utilizes the soldering portion 21' welding with the printed circuit board so that the soldering portion 21' is easy to fall off from the printed circuit board because the soldering portion 21' is under pressure frequently. For that reason, the signal between the battery connector 100' and a electronic device will be influenced. Furthermore, the assembly height of the battery connector 100' couldn't be adapted effectively so that it is not convenient for the assembly procedure.

Hence, the conventional battery connector can not ensure the signal between the battery connector and the electronic device transmitting stably, further, the height of the battery connector is not adjustable.

SUMMARY OF THE INVENTION

An object of the present invention is to provide a battery connector which ensures the signal between the battery connector and a electronic device transmitting stably and the assembly height of the battery connector is adjustable. The battery connector includes a dielectric housing. The dielectric housing has a plurality of terminal passages. The front portion of the terminal passage communicates with the outer space of the dielectric housing. The bottom portion of the terminal passage passes through the bottom surface of the dielectric housing. A plurality of terminals are received in the terminal passages. Each terminal includes a supporting portion, a press portion twisted up in the front portion of the supporting portion, a first bending portion extending from the rear portion of the supporting portion, an elastic portion formed on one end of the first bending portion, a plug portion extending from one end of the elastic portion opposite to the first bending portion, a second bending portion formed on the upper portion of the plug portion and a guidable portion extending from one end of the second bending portion opposite to the elastic portion. The battery connector utilizes the supporting portion and the press portion to elastically compress a printed circuit board so as to make the battery connector contact the printed circuit board all the time. Therefore, the signal between the battery connector and the electronic device is transmitted stably and the assembly height of the battery connector is effectively adjusted.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE PREFERRED EMBODIMENT

Detailed description will hereunder be given of the preferred embodiment of a battery connector according to the present invention with reference to the accompanying drawings.

Figure 1:
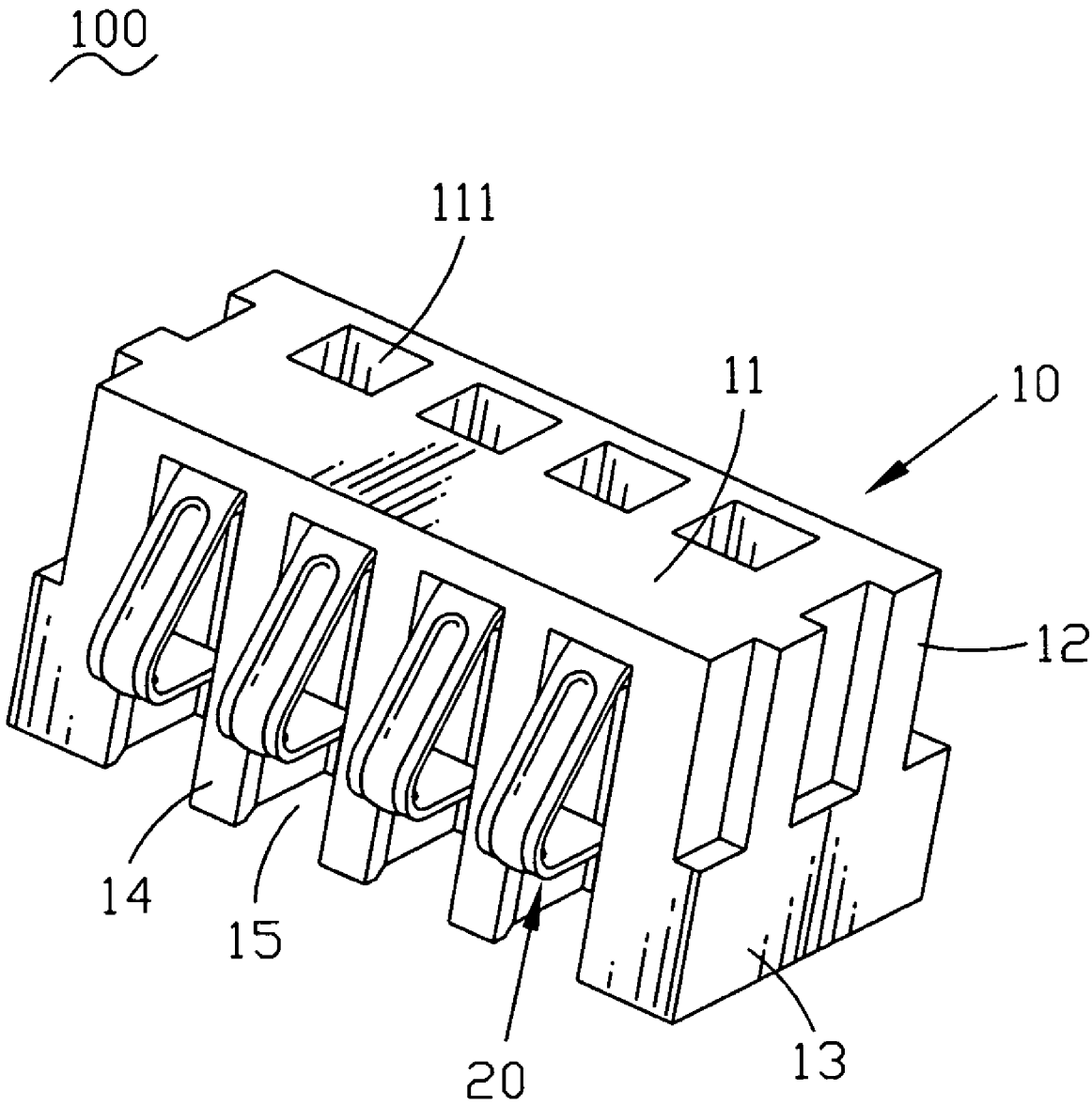
FIG. 1 is a perspective assembled view of a battery connector according to the invention.

Please refer to FIG. 1. A battery connector 100 according to the present invention includes a dielectric housing 10 and a plurality of terminals 20 which are received in the dielectric housing 10.

Figure 2:
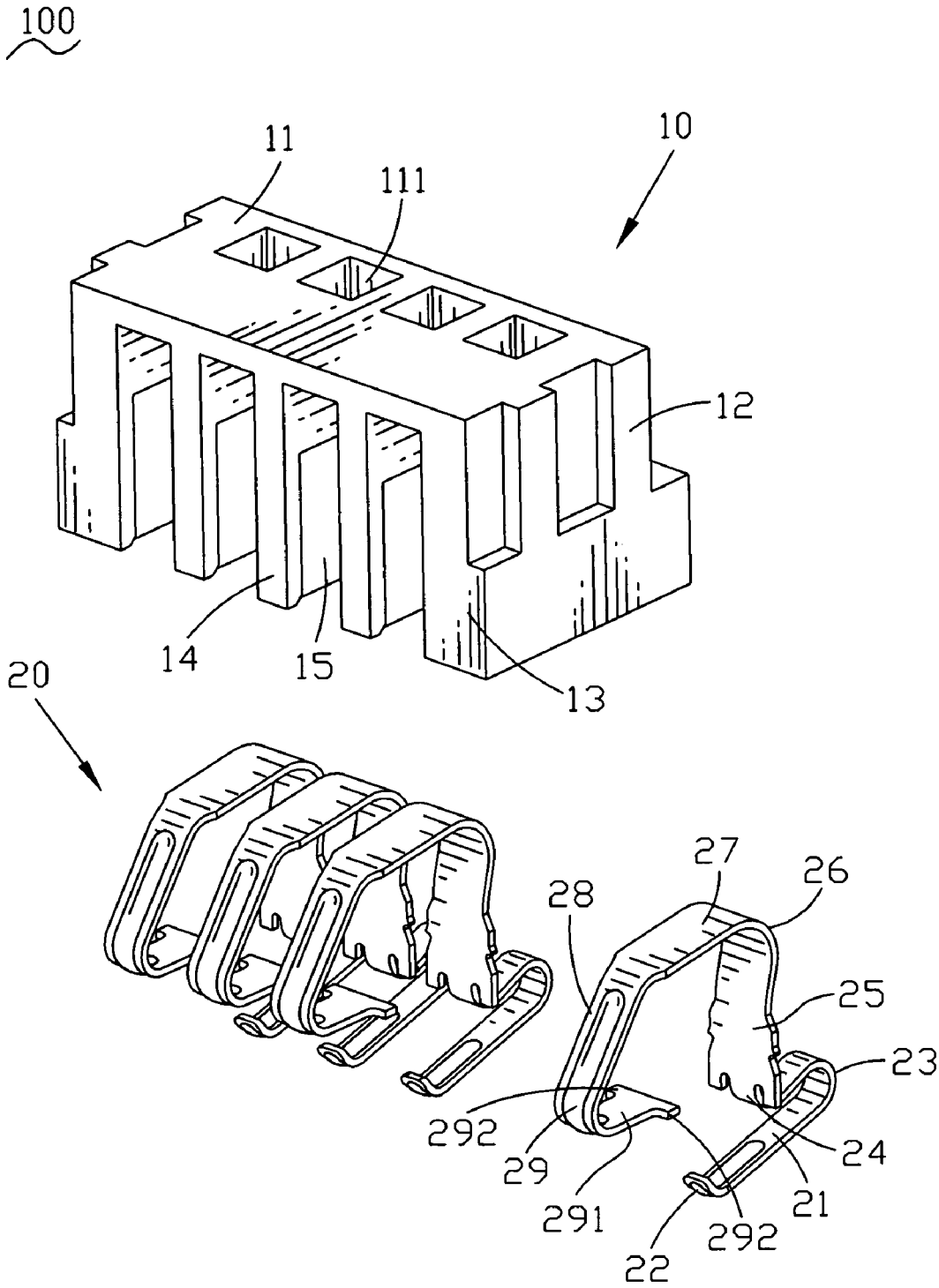
FIG. 2 is an exploded view of the battery connector according to the invention.
Figure 3:
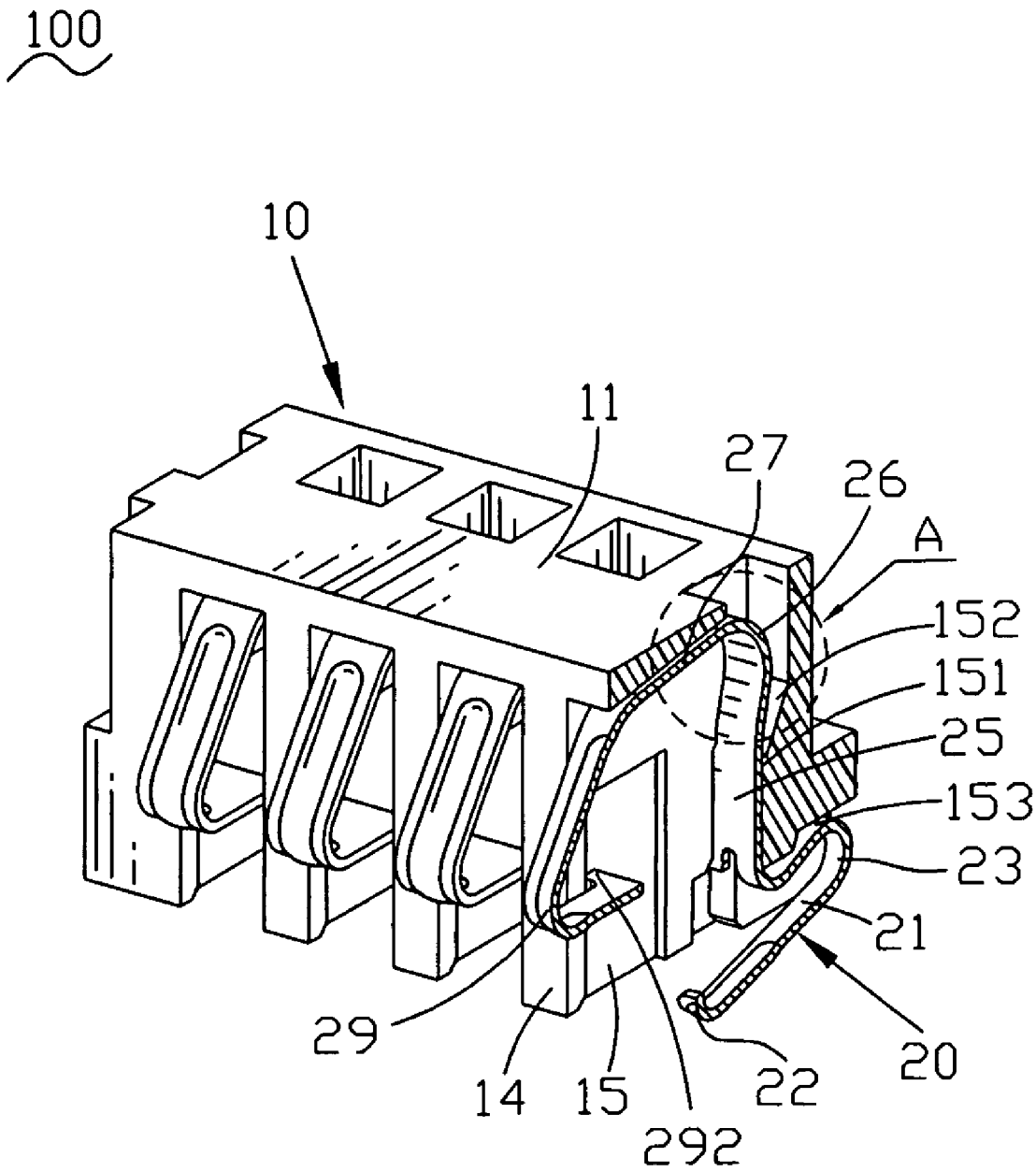
FIG. 3 is a cross-sectional view of the battery connector according to the invention.
Figure 4:
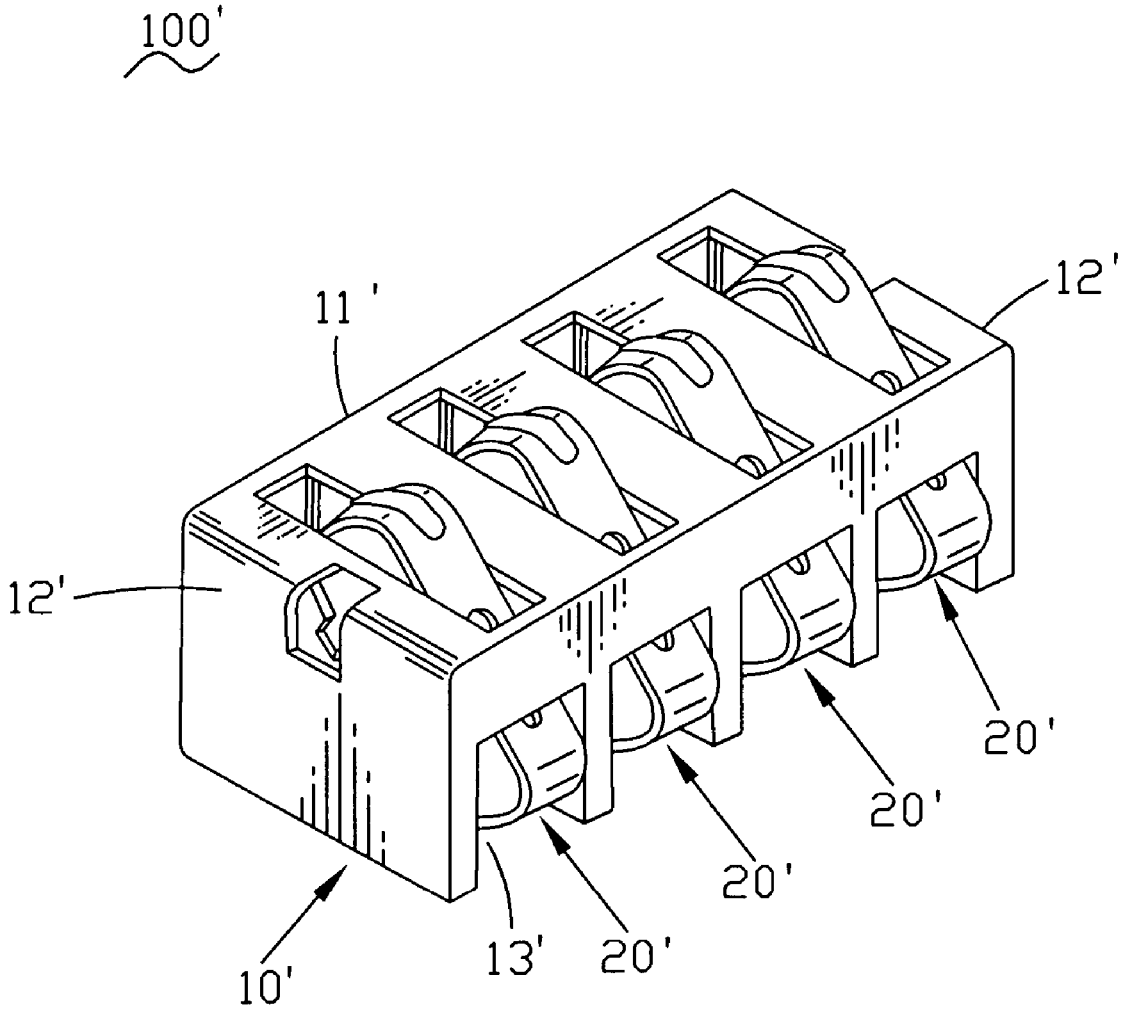
FIG. 4 (Prior Art)
FIG. 4 is a perspective view of a conventional battery connector.
Figure 5:
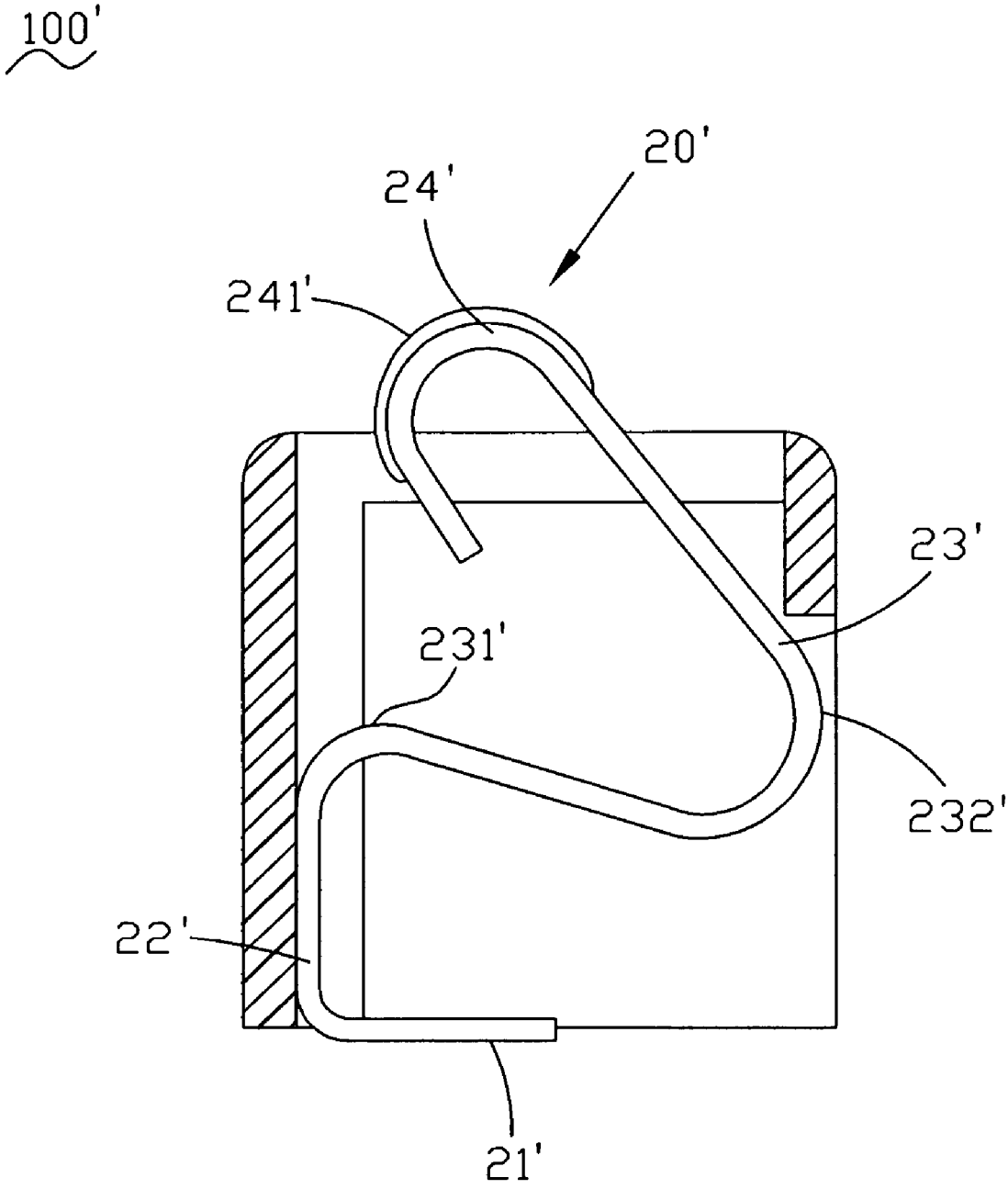
FIG. 5 (Prior Art)
FIG. 5 is a cross-sectional view of the conventional battery connector.

Referring to FIG. 2 and FIG. 3, the dielectric housing 10 includes a top plate 11, a plurality of through holes 111 forming in the top plate 11, a rear wall 12 vertically extending from the rear portion of the top plate 11 and two side walls 13 vertically extending from sides of the top plate 11. The top plate 11, the rear wall 12 and the side walls 13 cooperatively form an interior space of the dielectric housing 10. A plurality of insulating plates 14 vertically extend from the top plate 11. A plurality of terminal passages 15 are formed between the side walls 13 and the insulating plates 14. The front portion of the terminal passage 15 communicates with the outer space of the dielectric housing 10. The bottom portion of the terminal passage 15 passes through the bottom surface of the dielectric housing 10. Each through hole 111 communicates with each terminal passage 15 respectively. A block 151 is formed in the rear portion of the terminal passage 15. An anti-position wall 152 is formed on the upper portion of the block 151. A receiving passage 153 is formed below the block 151. The bottom portion of the receiving passage 153 communicates with the outer space of the dielectric housing 10.

Each terminal 20 has a supporting portion 21. A press portion 22 is twisted up in the front portion of the supporting portion 21. The bottom surface of the press portion 22 is an arc surface in order to enlarge the contacting area. A first bending portion 23 extending from the rear portion of the supporting portion 21. An elastic portion 24 is formed on the end of the first bending portion 23. A plug portion 25 extends from one end of the elastic portion 24 opposite to the first bending portion 23. A second bending portion 26 is formed on the upper portion of the plug portion 25. A connecting portion 27 extends from the front portion of the second bending portion 26. A guidable portion 28 extends downwardly from the connecting portion 27. A contacting portion 29 is formed on the front portion of the guidable portion 28. A straight portion 291 extends from the contacting portion 29. Two convexities 292 protrude from lateral sides of the end of the straight portion 291 respectively.

Please refer to FIG. 3, the following paragraphs will describe in detail the assembling of the battery connector 100.

The terminals 20 are received in the terminal passages 15 of the dielectric housing 10, respectively. The second bending portion 26 is received in the terminal passage 15 elastically. The contacting portion 29 extends out of the terminal passage 15 from the front surface of the dielectric housing 10 and communicates with a battery (not shown). The convexity 292 contacts the inner side of the front wall of the terminal passage 15. The connecting portion 27 contacts the inner side of the top plate 11. The plug portion 25 contacts the block 151. The elastic portion 24 and the first bending portion 23 are received in the receiving passage 153. The elastic portion 24 contacts the top wall of the receiving passage 153. The supporting portion 21 and the press portion 22 extend out of the dielectric housing 10 from the bottom portion of the terminal passage 15 in order to communicate with a printed circuit board (not shown).

When the battery connector 100 is assembled, the press portion 22 of the terminal 20 extends out of terminal passage 15 from the bottom portion of the terminal passage 15 and contacts the printed circuit board elastically. The contacting area between the press portion 22 and the printed circuit board is enlarged because the bottom surface of the press portion 22 is an arc surface. Therefore, the effect of the connection is enhanced by the enlarged contacting area. Furthermore, the assembly height of the battery connector 100 is convenient to be adjusted by the elastic contact between the press portion 22 and the printed circuit board.

When the battery connector 100 connects with the battery, the contacting portion 29 contacts the battery. The terminal 20 is easily to be deformed by the stress which comes from the battery. The terminal 20 receives the stress which centers on the "A" area so that the lifetime of the terminal 20 is easy to become short. However, when the stress passes to the second bending portion 26, the second bending portion 26 will disperse the stress because the second bending portion 26 is a big arc bend. In addition, when the second bending portion 26 receives the stress, the second bending portion 26 backwardly contacts the anti-position wall 152. The anti-position wall 152 also reacts on the second bending portion 26 so that the anti-position wall 152 shares the stress with second bending portion 26.

As described hereinabove, the battery connector 100 utilizes the press portion 22 to contact the printed circuit board elastically so that the assembly height of the battery connector 100 is adjustable. Furthermore, the arc surface of the press portion 22 contacts the printed circuit board all the time, therefore, the contact between the press portion 22 and the printed circuit board is stable. With this arrangement, the signal between the battery connector and the electronic device is much effective. In addition, the lifetime of the terminal 20 is prolonged because the second bending portion 26 is a big arc bend and disperses the stress effectively.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A battery connector, comprising:

a dielectric housing having a plurality of terminal passages defined therein, each terminal passage having a block, a receiving passage being formed on a bottom portion of the block, a bottom portion of the receiving passage communicating with an outer space of the dielectric housing, and an anti-position wall being angularly disposed at an upper portion of the block; and a plurality of terminals received in the plurality of terminal passages, each terminal having a supporting portion, a press portion twisted up in the front portion of the supporting portion, the supporting portion and the press portion extending out of a bottom surface of the dielectric housing for elastically contacting a printed circuit board, a first bending portion extending from a rear portion of the supporting portion, an elastic portion formed on one end of the first bending portion, a plug portion extending from one end of the elastic portion opposite to the first bending portion, the plug portion of the terminal contacts the block, a second bending portion formed on the upper portion of the plug portion, a guidable portion extending from the second bending portion, and a contacting portion being formed on a front portion of the guidable portion, wherein responsive to a battery being connected to the battery connector, the contacting portion moves from a pre-engagement position to a post-engagement position to thereby push the second bending portion toward the anti-position wall, the angular orientation of the anti-position wall providing space for the movement of the second bending portion for dispersing battery engagement forces on the terminal, the anti-position wall applying a reaction force to the second bending portion responsive to the second bending portion making contact therewith.

2. The battery connector as claimed in claim 1, wherein a contacting portion is formed on the front portion of the guidable portion.

3. The battery connector as claimed in claim 2, wherein a straight portion extends from the rear portion of the contacting portion, at least one convexity protrudes from lateral sides of the end of the straight portion.

4. The battery connector as claimed in claim 1, wherein the bottom surface of the press portion is an arc surface.

5. The battery connector as claimed in claim 1, wherein a connecting portion is defined on the front portion of the second bending portion.

* * * * *